United States Patent [19]

Genoa et al.

[11] Patent Number: 4,963,100

[45] **Date of Patent: * Oct. 16, 1990**

[54] ELECTRIFIED VACUUM CLEANER HOSE ADAPTER

[75] Inventors: Joseph Genoa, Freeport; Harold Kaskel, Long Beach, both of N.Y.; Carl Nelson, Wyckoff, N.J.

[73] Assignee: Atlantic Vacuum Parts Corp., Long Beach, N.Y.

[ * ] Notice: The portion of the term of this patent subsequent to Mar. 24, 2004 has been disclaimed.

[21] Appl. No.: 309,615

[22] Filed: Feb. 10, 1989

Related U.S. Application Data

[63] Continuation of Ser. No. 28,714, Mar. 20, 1987, Pat. No. 4,804,333, which is a continuation of Ser. No. 675,949, Nov. 28, 1984, Pat. No. 4,652,063.

[51] Int. Cl.[5] ..... H01R 4/64

[52] U.S. Cl. ..... 439/191

[58] Field of Search ..... 439/191, 192, 193, 194; 285/7; 15/377, 410

[56] References Cited

U.S. PATENT DOCUMENTS

| | | | |
|---|---|---|---|
| 3,314,039 | 4/1967 | Opper | 285/7 |
| 3,553,629 | 1/1971 | Brown et al. | 439/191 |
| 3,614,705 | 10/1971 | Descarries et al. | 439/191 |
| 4,018,493 | 4/1977 | Lyman et al. | 439/191 |
| 4,283,594 | 8/1981 | Somers | 15/377 |
| 4,316,304 | 2/1982 | Parise | 15/377 |
| 4,494,270 | 1/1985 | Ritzau et al. | 439/191 |

FOREIGN PATENT DOCUMENTS

| | | | |
|---|---|---|---|
| 919337 | 2/1963 | United Kingdom | 285/7 |

*Primary Examiner*—Neil Abrams

*Attorney, Agent, or Firm*—Frishauf, Holtz, Goodman & Woodward

[57] ABSTRACT

An electrified vacuum cleaner hose adapter for electrically and mechanically interconnecting an electrified vacuum cleaner hose with an electrified vacuum cleaner wand or accessory, comprises a handle portion which includes two tubular portions set at an angle to each other, an inlet member for connecting to a vacuum cleaner hose and an outlet member for connecting to the vacuum cleaner wand or accessory. Electrical connectors are provided at each end of the handle portion of the adapter for connecting with corresponding electrical conductors of the hose and wand, respectively. An electrical wire extends between the connectors. The connectors and the electrical wire are covered by a channel-shaped member which defines a closed passage in the handle portion for enclosing the electrical connectors and wire and for serving as a manually grippable protrusion on the handle portion.

16 Claims, 2 Drawing Sheets

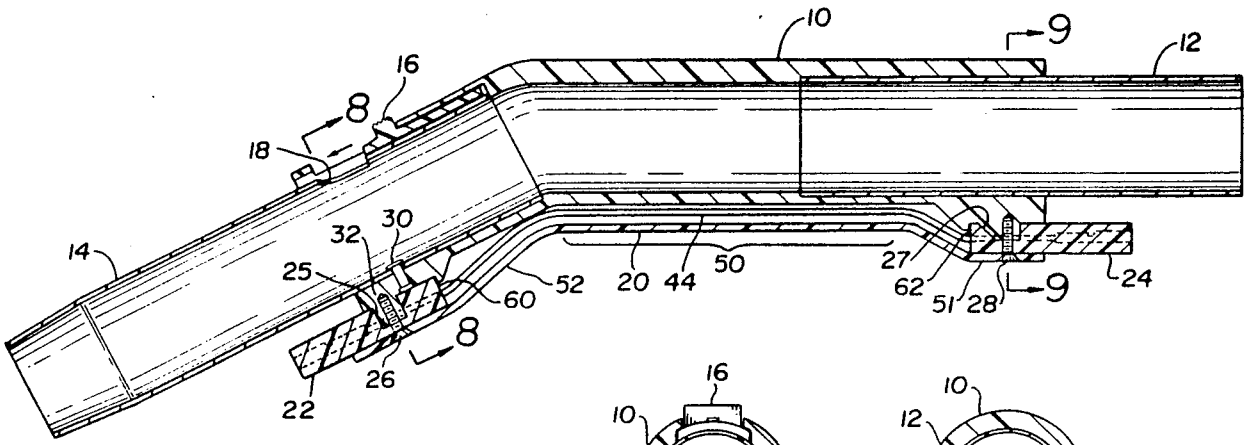
FIG. 7
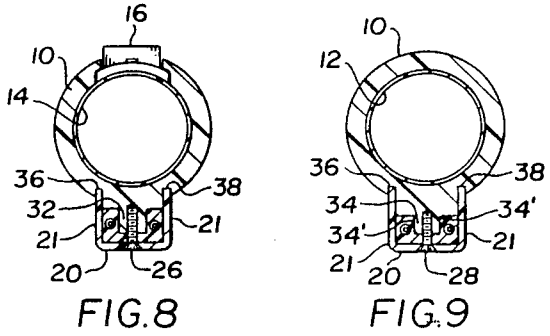
FIG. 9
FIG. 8
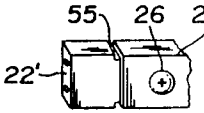
FIG. 10
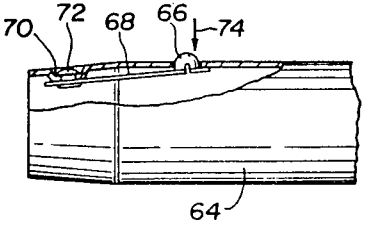
FIG. 11

ELECTRIFIED VACUUM CLEANER HOSE ADAPTER

This is a continuation of application Ser. No. 07/028,714, filed Mar. 20, 1987, now U.S. Pat. No. 4,804,333, issued Feb. 14, 1989, which is a continuation of Ser. No. 06/675,949, filed Nov. 28, 1984, now U.S. Pat. No. 4,652,063, issued Mar. 24, 1987.

CROSS REFERENCE TO RELATED APPLICATION

U. S. Design Application Ser. No. 648,642, filed Sept. 7, 1984 in the names of the same inventors as in the present application.

BACKGROUND OF THE INVENTION

This invention relates to an electrified vacuum cleaner hose adapter, and more particularly to a hose adapter having a handle portion which is gripable by a user, and which interconnects an electrified vacuum cleaner hose with an electrified vacuum wand and working implement, such as a rug beater or the like.

In many instances, various manufacturers of vacuum cleaners make specialized interconnecting devices which are not readily obtainable, or which are obtainable only at relatively high price. On the other hand, many manufacturers make generic replacement parts which are adapted for use with many different types of vacuum cleaners, but not for all.

It is the main object of the present invention to provide an electrified vacuum cleaner hose adapter which permits using conventional, relatively low-priced generic type electric hoses in combination with electrified vacuum cleaner attachments such as wands having rug-beaters at the end thereof.

SUMMARY OF THE INVENTION

According to the present invention, an electrified vacuum cleaner hose adapter for interconnecting an electrified vacuum cleaner hose with an electrified wand or accessory, comprises a generally tubular handle portion which has a first generally tubular portion integral with a second tubular portion, the first and second tubular portions having longitudinal axes which are at an angle with each other; an inlet member coupled to said handle portion and including a tubular section extending from one end of the handle portion and which is receivable in an opening of an electrified vacuum cleaner hose; and an outlet member coupled to the handle portion and including a tubular section extending from the other end of the handle portion and which is receivable in an opening of an electrified vacuum cleaner wand or accessory. The adapter further comprises a first connector connected to the end portion of the handle portion adjacent the inlet member and having electrical contacts for matingly and electrically connecting with an electrical connector of the electrified vacuum cleaner hose; a second connector connected to the end portion of the handle portion adjacent the outlet member and having electrical contacts for matingly and electrically connecting with an electrical connector of the electrified wand or accessory; a pair of electrical conductors extending between and electrically connecting the first and second connectors; and a channel-shaped manually grippable member connected to the handle portion and protruding from the handle portion over a substantial portion of the length of the handle portion and extending between the first and second connector means and defining a channel-shaped covered passage between the connectors, the electrical conductors extending within the covered passage so as not to be exposed to the outside of the covered passage, the protruding portion of the channel-shaped member at least partly defining the covered passage and defining a manually grippable, slip resistant portion of the adapter when the user's hand is gripped around the adapter.

BRIEF DESCRIPTION OF THE DRAWINGS

FIG. 7 is a sectional view thereof showing the internal mechanisms and electrical interconnecting means;

FIG. 8 is a section taken along line 8—8 in FIG. 7;

FIG. 9 is a sectional view taken along line 9—9 in FIG. 7;

FIG. 10 illustrates a modified connector member; and

FIG. 11 illustrates another embodiment of the outlet member.

DETAILED DESCRIPTION

Figure 1:
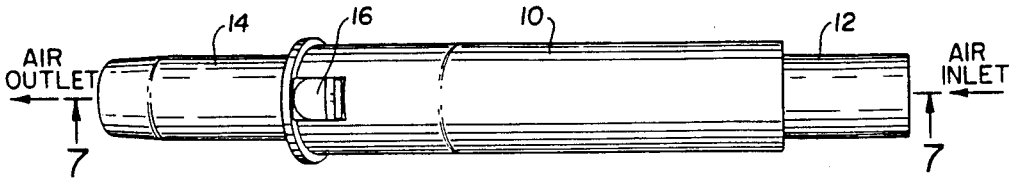
FIG. 1 is a plan view of a vacuum cleaner hose adapter according to the present invention.

Referring to FIGS. 1-6, the electrified vacuum cleaner hose adapter of the present invention generally comprises a substantially tubular handle portion 10 (preferably made of plastic material), a substantially tubular inlet member 12 (preferably made of metallic material) and a substantially tubular outlet member 14 (preferably made of metallic material). A slidable air throttle control 16 is provided for selectively opening and closing an opening 18 in the hose adapter. The air throttle control is generally conventional and does not form a novel feature of the present invention.

Figure 3:
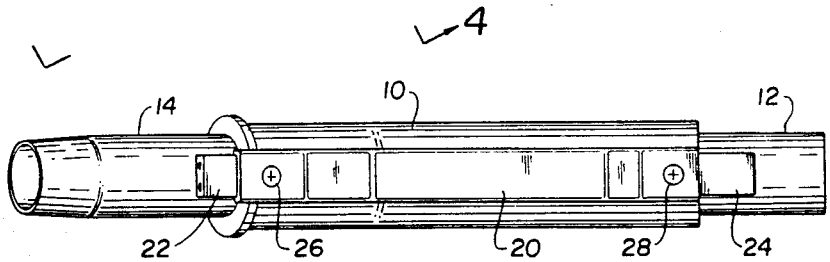
FIG. 3 is a bottom view thereof.
Figure 4:
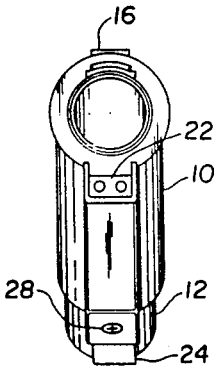
FIG. 4 is an end view thereof as seen along the line 4—4 in FIG. 2.
Figure 5:
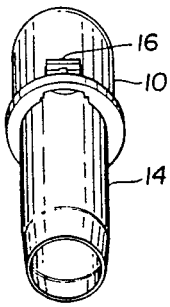
FIG. 5 is a left end elevational view thereof with respect to FIG. 2.
Figure 6:
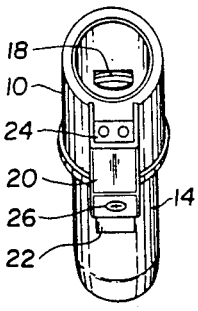
FIG. 6 is a right end elevational view thereof with respect to FIG. 2.

At the lower portion of the handle portion 10 a channel-type housing 20 is provided with electrified female plugs 22, 24 extending from opposite ends thereof. The housing 20 is preferably retained within notches or cut-outs formed in the handle portion 10 (to be described later) and is secured in place by means of screws 26,28, as best seen in FIG. 3.

In use, the inlet member 12 is inserted into a receiving opening of an electrified vacuum cleaner hose which has an electrical connector at the end thereof which electrically and mechanically matingly engages with the plug 24. The parts are preferably adhesively or otherwise fixedly connected together so that the electrified hose and the adapter of the present invention are secured together as an integral unit. The interconnection is preferably by means of an adhesive, but may be by means of screws or other interconnecting elements, as desired. The left hand end or outlet member 14 is insertable into a receiving opening in a vacuum cleaner wand which has a connector at the receiving end thereof, the connector of the wand mating with connector 22 physically and electrically to provide electrical power from the electrified hose, through the adapter of the present invention, and to the wand, which has an electrical implement at the remote end thereof, such as a rug beater. The interconnection of outlet member 14 with the wand is preferably not made permanent. In general usage, the wand is disconnected from the adapter of the present invention for ease of storage of the various parts. Since the electrical connector 22 at the outlet end of the adaptor of the present invention is a female connector, there is no danger of electric shock or the like when the wand is disconnected from the outlet member 14 of the adapter. Since the inlet member 12 is fixedly and permanently received in the hose, there is no danger of electric shock from any exposed electrical connector parts.

Referring to FIGS. 7–9, the invention will be described further in greater detail. The handle portion 10 is preferably made of a plastic material (ABS) and is generally of a bent tubular shape. The forward end of the handle portion 10 receives an outlet member 14, which is preferably a tubular metallic member, which is secured within the handle portion 10 preferably by means of a rivet 30, as shown in FIG. 7. Alternatively, the outlet tube 14 may be bonded to the forward end of the handle portion 10, and a rivet can be used to strengthen the bonded interconnection. Similarly, the inlet member 12 is a generally tubular metallic member and is preferably molded directly to the interior of handle portion 10, as shown in FIG. 7. The other surface of portion 12 may be roughened or otherwise conditioned to improve adhesion to handle portion 10 during and after molding.

The handle portion 10 has a protrusion 32 extending downwardly therefrom at the outlet end portion thereof, and a protrusion 34 extending downwardly therefrom at the inlet end portion thereof. As seen in FIGS. 8 and 9, the handle portion 10 has grooves 36, 38 formed along the surface thereof between the protrusions 32, 34, and in which the generally U-shaped channel-shaped housing 20 is received. The housing 20 is fixedly and removably connected to the handle portion 10 preferably by means of screws 26, 28. Other connecting means, such as rivets, adhesives or the like, could be used to connect the housing 20 with the handle portion 10. Screws 26, 28 (or rivets) are preferred since not only do these members serve to connect the housing 20 with the handle portion 10, but they also serve to retain the connectors in position in the longitudinal direction of the adapter. The connectors 22,24 have cut-out portions 25,27, respectively, which matingly engage with the protrusions 32,34 of the handle member 10. This mating engagement effectively "locks" and retains the connectors 22,24 in place, and the screws 26,28 serve to securely retain the members in their fixed, locked position. The protrusions 32,34 have different shapes, so that the respective connectors 22,24 are engageable with only a given one of the protrusions 32,34. Protrusion 32 is generally cylindrical and protrusion 34 is generally trapezoidal with flat sides 34'. The flat sides 34' reduces twisting of the connector on the protrusion. The sides of the protrusion 32 may also be flat for the same reason. The handle portion 10 also has stop members 60, 62 molded integrally therewith, against which the rear surfaces of the connectors 22,24, respectively engage. These "stop" members 60,62 inhibit the connectors 22, 24 from moving backward during engagement thereof with their respective mating connectors on the vacuum cleaner hose and wand. The stop members 60,62 are also preferably substantially flat in the plane perpendicular to the page of FIG. 7, and engage with substantially flat rear end surfaces of the connectors 22,24, thereby also preventing twisting of the connectors relative to the handle portion 10, during engagement thereof with mating connectors, and also during use of the device.

Extending between connectors 22,24 is a pair of wires 44 which respectively interconnect the pair of receptacles of the connectors 22,24. Thus, electrical power received from a vacuum cleaner hose which is connected at the inlet end 12 is transferred to the receptacles of the connector 24, through the wires 44, to the pin receptacles of the connector 22, and then to the vacuum cleaner wand and electrical accessory through interconnection with the connector 22. While the connectors 22,24 are shown as being female connectors, it should be clear that male connectors may be used for one or both of the connectors 22. To increase safety, in some instances it may be desirable to use a male connector in place of connector 24, which will mate with a live female connector of the electrified vacuum cleaner hose. In the unlikely event of the adapter of the present invention becoming disconnected from the electrified hose, this would prevent exposure of live connectors at the end of the electrified vacuum cleaner hose.

The channel-shaped housing 20 has substantially flat side walls 21 which contact substantially flat side walls of the connectors 22,24, as seen in FIGS. 8 and 9. This engagement helps stabilize the connectors 22,24 to further inhibit twisting of the connectors either during interconnection or during use of the device. By virtue of the engagement of the connectors with the respective protrusions 32,34, the end-stops 60,62, the side wall engagement with the channel sides 21 and the locking engagement with the screws 26,28, the connectors 22,24 are firmly held in place to inhibit breakage or movement relative to the adaptor, either during interconnection with other connectors, or during use of the device by a user, even under extreme use and handling conditions.

The arrangement of the present invention not only provides proper electrical connection to enable interconnecting a conventional generic-type hose with a vacuum cleaner electrified wand, but also provides a handle member 10 with a convenient hand gripping portion 50 (see FIG. 7). In use, the user's hand grips the handle portion 10 around the area 50, with the fingers of the hand extending over and around housing 20. The downwardly extending portion 51 of the housing 20 serves as a "stop" to prevent the user's hand from inadvertently slipping rearwardly on the handle portion 10, and the forward downwardly extending portion 52 of the housing 22 serves effectively as a "stop" to prevent slipping of the user's hand past the angularly curved forward portion of the adapter. The housing 20 also extends downwardly of the handle portion 10 (see FIGS. 2 and 7). This provides a protruding gripping portion to prevent slipping of the user's hand circumferentially of the handle portion 10. By virtue of the above arrangement of the housing 20 relative to the handle member 10, a convenient and secure gripping of the adaptor of the present invention is achieved, even when the user's hands are dirty, or slippery due to perspiration, grease or the like. Thus, the protruding housing serves not only as a convenient grip-improving member and slippage reducing member, it also serves as the hollow housing for passing the wire between the connectors, without requiring that the air passage through the adaptor of the present invention be reduced to accommodate the wires 44. Since the housing 20 is removably secured to the handle portion 10, the connectors and wire may be replaced, if necessary.

Figure 2:
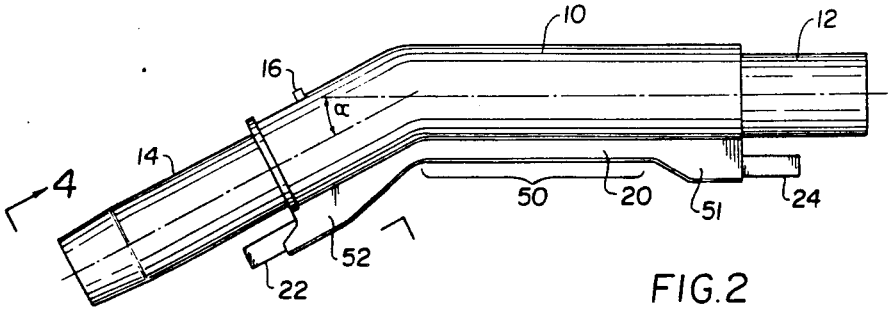
FIG. 2 is a side elevational view thereof.

Another important feature of the present invention is the angular disposition between the outlet member 14 and the inlet member 12. As seen in FIG. 2, the angle between the center lines of members 12 and 14 is preferably approximately 27°. This provides a very convenient operating angle between the hand gripping portion 50 of the handle portion 10 and the wand which connects to outlet member 14. Other similar angles, such as from about 25 to 30° may be used. The prior art angular relationship of 45° has been found to be inconvenien and more difficult to use.

FIG. 10 shows a modified embodiment wherein the connector 22' is enlarged at the portion thereof which extends outwardly from channel 20. This improves the interengagement of the connector 22' with the channel 20 and increases the strength of the resultant arrangement. The connector 22' is shown slightly spaced from the channel member 20 in FIG. 10 for clarity, but in practice, the space 55 does not exist-the connector is preferably in contact with the end of the channel 20. Similarly, the connector 24 at the other end of the adapto can be enlarged at the portion thereof which extends outwardly of the channel.

FIG. 11 shows another embodiment of an outlet member 14 to enable the device to be usable with various specific types of vacuum cleaner wands. Referring to FIG. 11, the outlet member 64, the tip end of which is shown for ease of illustration, comprises a spring-mounted button member 66, which engages into a corresponding opening of a vacuum wand (not shown). The button 66 is integral with a leaf spring member 68 which is connected at a depression 70 of outlet member 66 via a rivet 72. The button member 66 springs downwardly in the direction of the arrow 74 during engagement with the vacuum cleaner wand, and springs outwardly when it is in registration with the corresponding opening or hole (not shown) of the vacuum cleaner wand.

We claim:

1. An electrified vacuum cleaner hose adapter for interconnecting an electrified vacuum cleaner hose with an electrified wand or accessory, comprising:

a generally tubular main handle member (10) comprising a first generally tubular portion integral with a second generally tubular portion, said first and second tubular portions having respective longitudinal axes which are at an angle with each other;

a tubular inlet member (12) at one end portion of said first tubular portion and which is receivable in an opening of an electrified vacuum cleaner hose;

a tubular outlet member (14) at one end portion of said second tubular portion and which is receivable in an opening of an electrified vacuum cleaner wand or accessory;

first electrical connector means (24) connected to the one end portion of said first tubular portion adjacent said inlet member (12) and having electrical contacts for matingly and electrically connecting with an electrical connector of said electrified vacuum cleaner hose;

second electrical connector means (22) connected to the one end portion of said second tubular portion adjacent said outlet member (14) and having electrical contacts for matingly and electrically connecting with an electrical connector of said electrified wand or accessory;

a pair of electrical conductors extending between and electrically connecting said first and second electrical connector means;

an elongated projecting member (20) fixedly coupled to said main handle member and having a protruding portion protruding from a lower side of said main handle member over at least a substantial portion of the length of said main handle member and extending between said first and second electrical connector means and defining a covered passage between said first and second electrical connector means, said electrical conductors extending within said covered passage so as not to be exposed to the outside of said covered passage, said protruding portion of said projecting member (20) at least partly defining said covered passage and also defining a manually grippable, slip resistant portion (50) over a predetermined portion of the length of said protruding portion, said slip resistant portion (50) extending substantially along said first tubular portion for engagement with a user's hand when a user's hand is gripped around said first tubular portion of said adapter;

said projecting member (20) having connector receiving and engaging means at each opposite end thereof, for receiving and engaging said first and second electrical connector means, respectively, and in cooperation with said main handle member, for fixedly maintaining said first and second electrical connector means in a fixed position; and at least one elongated connecting means (26,28) passing at least through said projecting member, and at least partially through said main handle member to fix said projecting member relative to said main handle member and to secure said electrical connector means in a fixed position;

said elongated projecting member (20) being thereby fixedly coupled to said main handle member such that it is immovable relative to said main handle to positively prevent said elongated projecting member (20) and said electrical connector means from moving circumferentially around said main handle member during use, thereby maintaining structural integrity, grippability and safety during use.

2. The adapter of claim 1, wherein said protruding portion of said projecting member comprises said slip resistant portion (50) which protrudes from said main handle member by a predetermined amount, a forward portion (52) which protrudes from said main handle member by an amount greater than said intermediate portion, and a rear portion (51) which protrudes from said main handle member by an amount greater than said intermediate portion, said forward and rear protruding portions (52,51) serving as stop members to prevent a hand of a user from sliding forward or rearward, respectively, past said stop members.

3. The adapter of claim 1, wherein said projecting member has sloping portions between said intermediate portion and said rear and forward portions, respectively, said sloping portions serving as said stop means.

4. The adapter of claim 2, wherein said main handle member has a pair of spaced apart grooves (36,38) extending longitudinally thereof, and said projecting member (20) has a pair of elongated free ends which are engageable in said grooves to prevent said projecting member from moving circumferentially around said main handle member.

5. The adapter of claim 1, wherein said main handle member has a pair of spaced apart grooves (36,38) extending longitudinally thereof, and said projecting member (20) has a pair of elongated free ends which are engageable in said grooves to prevent said projecting member from moving circumferentially around said handle portion.

6. The adapter of claim 1, wherein said main handle member (10) has protruding members (32,34) at the opposite ends thereof, and wherein said first and second connector means (22,24) have respective openings therein for engaging with said protruding members (32,34).

7. The adapter of claim 6, wherein said protruding members (32,34) have stop means (60,62), and wherein said first and second connector means have respective rear surfaces which face toward the central portion of said main handle member (10) and which are in contact with said stop means (60,62) of said main handle member for preventing movement of said first and second connector means toward the central portion of said main handle member.

8. The adapter of claim 7, further comprising respective screws for passing through respective openings at end portions (51,52) of said projecting member and through openings in said respective first and second connector means, and being threadably engageable with respective screw-receiving members of said main handle member (10), thereby fixedly connecting said projecting member to said main handle member with said connector means interposed between said projecting member and said main handle member.

9. The adapter of claim 1, further comprising rivet means extending through said outlet member (14) and to said main handle member (10) for fixedly and mechanically connecting said outlet member (14) to said main handle member (10) to prevent relative movement therebetween.

10. The adapter of claim 2, further comprising rivet means extending through said outlet member (14) and to said main handle member (10) for fixedly and mechanically connecting said outlet member (14) to said main handle member (10) to prevent relative movement therebetween.

11. The adapter of claim 3, further comprising rivet means extending through said outlet member (14) and to said main handle member (10) for fixedly and mechanically connecting said outlet member (14) to said main handle member (10) to prevent relative movement therebetween.

12. The adapter of claim 1, further comprising screw means extending through said outlet member (14) and to said main handle member (10) for fixedly and mechanically connecting said outlet member (14) to said main handle member (10) and to prevent relative movement therebetween.

13. The adapter of claim 1, wherein said inlet member (12) is integrally molded with said main handle member (10).

14. The adapter of claim 1, wherein said projecting member (20) has surfaces which contact corresponding side surfaces of said first and second connector means for preventing twisting of said first and second connector means relative to said projecting member.

15. The adapter of claim 1, wherein said first and second tubular portions are each substantially straight, and wherein said first tubular portion is arranged closer to the user than said second tubular portion, and is arranged to be substantially horizontal when said second tubular portion is downwardly inclined.

16. The adapter of claim 1, comprising mechanical interconnecting means between said electrical connector means and respective ends of said main handle member, said interconnecting means comprising a projection on at least one of said main handle member and said electrical connector means, and a receptacle on the other of said main handle member and said electrical connector means, said projection and receptacle matingly engaging each other to enhance the structural integrity of the inteconnection between said projecting member, said electrical connector means, and said main handle member.

* * * * *